United States Patent [19]

Ueda

[11] 4,271,855

[45] Jun. 9, 1981

[54] COIN SELECTING APPARATUS

[75] Inventor: Nobuo Ueda, Tokyo, Japan

[73] Assignee: Laurel Bank Machine Co., Ltd., Tokyo, Japan

[21] Appl. No.: 973,920

[22] Filed: Dec. 28, 1978

[51] Int. Cl.[3] ..... G07D 3/02

[52] U.S. Cl. ..... 133/3 D; 133/3 F

[58] Field of Search ..... 133/3 R, 3 D, 3 F, 3 H, 133/8 R, 8 E

[56] References Cited

U.S. PATENT DOCUMENTS 3,795,253 3/1974 Hatanaka et al. ..... 133/3 A

FOREIGN PATENT DOCUMENTS 2623974 12/1977 Fed. Rep. of Germany ..... 133/3 F
39-13111 7/1964 Japan .
45-34084 11/1970 Japan .

*Primary Examiner*—F. J. Bartuska
*Attorney, Agent, or Firm*—Fleit & Jacobson

[57] ABSTRACT

Herein disclosed is a coin selecting apparatus for selecting or classifying mixed coins in accordance with their diameters. The coin selecting apparatus includes a selecting track which is formed in its bottom with a plurality of selecting holes. These holes are arranged in a row in the flow direction of the coins and are sized to have stepwisely larger widths in the downstream direction of the coin flow so that they may allow the coins to pass down therethrough to be classified. The coin selecting apparatus further includes a selecting belt mechanism which is operative to convey the coins on the selecting track so that coins may fall into the selecting holes in order of increasing coin diameter. The selecting belt mechanism is composed of a plurality of belt carrying mechanisms which are arranged on the selecting track for carrying a corresponding number of belts such that the running directions of the belts are inclined at a preset angle with respect to the longitudinal direction of the selecting track and that each of the belts partially overlaps the next downstream belt.

5 Claims, 6 Drawing Figures

COIN SELECTING APPARATUS

BACKGROUND OF THE INVENTION

1. Field of the Invention

The present invention relates to a money classifying apparatus, and more specifically to a coin selecting apparatus for selecting mixed coins in accordance with their kinds.

2. Description of the Prior Art

The conventional apparatus of this type is known to include a turning disc mechanism for continuously discharging mixed coins in a single file, a selecting track which is arranged to lead from the outlet of the turning disc mechanism and which is formed in its bottom with a variety of selecting holes having different widths, and a selecting belt mechanism for unidirectionally conveying the coins on the selecting track. The coins thus aligned by the selecting belt mechanism are brought onto the selecting track so that they may fall into the selecting holes in accordance with the kinds thereof.

In such conventional apparatus (e.g. those disclosed in Japanese Patent Publications No. 34080/1970 and 13111/1964), however, only one belt for conveying the coins is arranged to extend over the whole length of the selecting track at an inclination to the longitudinal direction of the selecting track. The inclination is intended to force the coins being conveyed into contact with the reference wall of the selecting track. Since, however, the selecting belt mechanism uses only one belt, the angle of inclination is inevitably restricted to such a small value that the coins may often fail to make sufficient contact and accordingly to reliably fall into their corresponding selecting holes. Since, on the other hand, the mixed coins are conveyed at the same speed at all points on the selecting track, the spaces between the coins being conveyed increase as the selecting operations advance, thus reducing the selecting efficiency.

SUMMARY OF THE INVENTION

It is therefore an object of the present invention to provide a coin selecting apparatus which is free from any of the drawbacks of the prior art.

Another but major object of the present invention is to provide a coin selecting apparatus of the above type which can accomplish reliable and prompt selecting operations in accordance with the sizes of the coins.

A further object of the present invention is to provide a coin selecting apparatus of the above type which is free from any trouble during transfer of the coins between two adjacent coin conveying belts.

A further object of the present invention is to provide a coin selecting apparatus of the above type which can facilitate removal of deformed coins, if any.

A further object of the present invention is to provide a coin selecting apparatus of the above type in which the coins never pass over the corresponding selecting hole without fall thereinto.

According to a major feature of the present invention, there is provided a coin selecting apparatus for selecting mixed coins in accordance with the diameters thereof, comprising: a selecting track formed in its bottom with a plurality of selecting holes which are arranged in a row in the flow direction of the coins and which are sized to have stepwise larger widths in the downstream direction of the coin flow; and a selecting belt mechanism for conveying the coins on the selecting track so that the coins may fall into the selecting holes in the order of increasing coin diameter, wherein the improvement resides in that said selecting belt mechanism includes a plurality of belt carrying mechanisms arranged on said selecting track for carrying a corresponding number of belts such that the running directions of the belts are inclined at a preset angle with respect to the longitudinal direction of said selecting track and that each of the belts partially overlaps the next downstream belt.

DESCRIPTION OF THE DRAWINGS

Other objects and advantages of the present invention will become apparent from the following description made with reference to the accompanying drawings, in which.

DESCRIPTION OF THE PREFERRED EMBODIMENT

Figure 1:
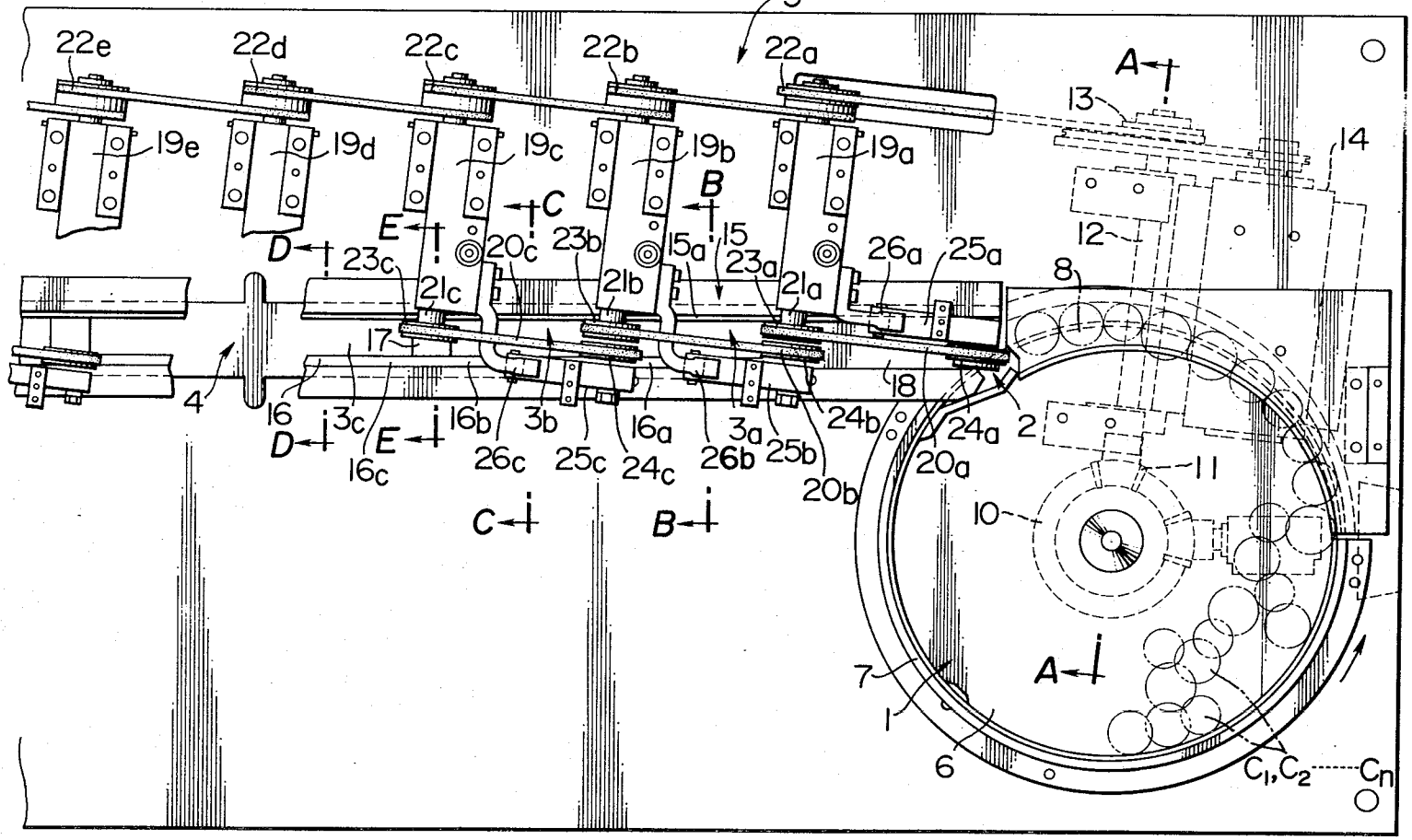
FIG. 1 is a partially cut-away top plan view showing a coin selecting apparatus in accordance with the present invention.
Figure 2:
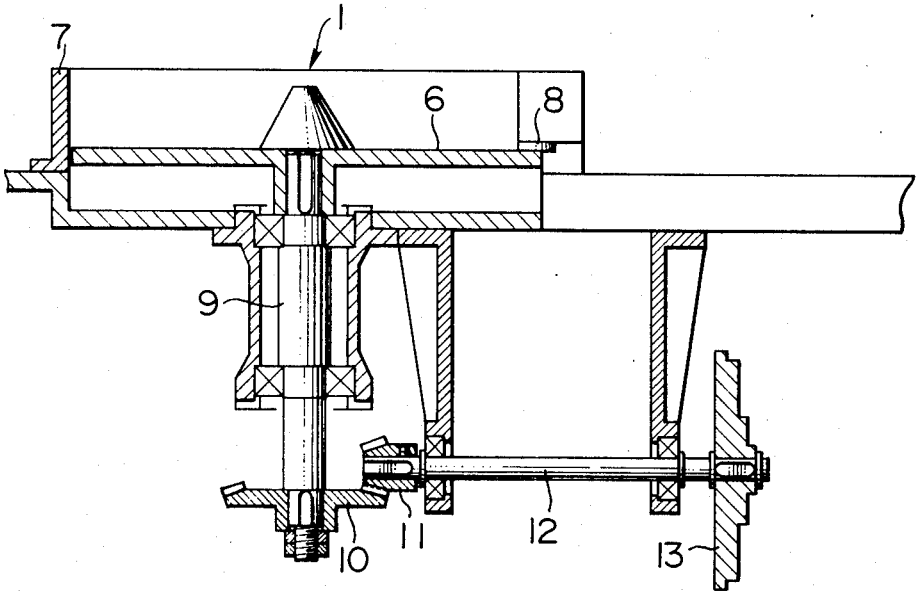
FIG. 2 is an enlarged cross-sectional view taken along the line A—A of FIG. 1 showing the structural arrangement of the drive train used in the coin selecting apparatus.

One embodiment of the present invention will now be described in detail with the reference to the accompanying drawings.

The coin selecting apparatus according to the present invention is constructed to include a turning disc mechanism 1 which is made operative to continuously discharge a number of mixed coins $C_1, C_2, ---, C_n$ by its centrifugal force in a manner to align them into a row. The apparatus further includes a selecting track 4 extending from the outlet 2 of the turning disc mechanism 1 and formed at its bottom with a number of selecting holes 3*a*, 3*b*, - - -, 3*n* of increasingly larger sizes. Further provided is a selecting belt mechanism 5 for unidirectionally conveying the mixed coins $C_1, C_2, ---, C_n$ on the selecting track 4.

The turning disc mechanism 1 is equipped with a selecting ring 7 around a rotary disc 6 and is provided with a coin aligning course 8 in the vicinity of its outlet 2. The rotary disc 6 is turned by a power transmission train, comprising a smaller bevel gear 11 in meshing engagement with a larger bevel gear 10 mounted to the spindle 9 of the rotary disc 6, a drive pulley 13 mounted on one end of a spindle 12 of the smaller gear 11, and an electric motor 14 which drives the drive pulley 13. Thus, when the motor 14 is energized, the drive pulley 13 is turned so that the smaller gear 11 is turned through their common spindle 12. The larger gear 10 is turned by the smaller gear 11 which causes the rotary disc 6 to be turned via the common spindle 9. As a result, the mixed coins $C_1, C_2, ---, C_n$ on the rotary disc 6 are fed along the selecting ring 7 to the coin aligning course 8 by the rotation of the rotary disc 6. In the coin aligning course 8, the mixed coins $C_1, C_2, --- C_n$ advance continuously in a single row.

Figure 3:
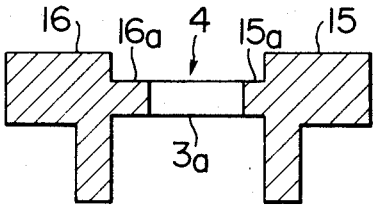
FIGS. 3 to 6 are enlarged cross-sectional views taken along the lines B—B, C—C, D—D and E—E of FIG. 1 to show the construction of the coin selecting track.
Figure 4:
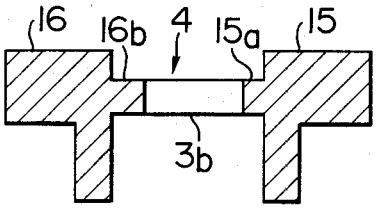
Figure 5:
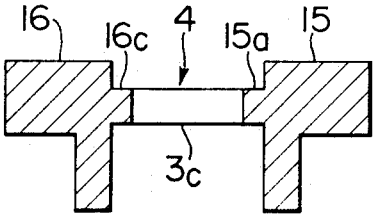
Figure 6:
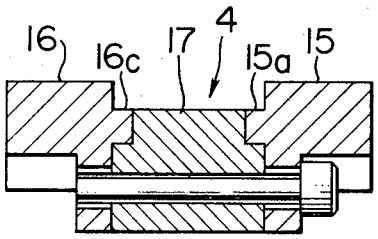

The selecting track 4 is provided with a reference rail 15 and a selecting rail 16 arranged in parallel at a preset spacing. The reference rail 15 is formed with a guide edge 15*a* having a preset extension or width whereas the selecting rail 16 is formed with a corresponding number of selecting edges 16a, 16b, - - -, 16n as better seen from FIGS. 3 to 6. Each of the aforementioned selecting holes 3a, 3b, - - -, 3n is formed between the guide edge 15a and one of the guide edges 16a, 16b, - - - 16n. Here, it should be noted that the selecting edge 16a of the selecting rail 16 is made to have the largest extension whereas the remaining selecting edges 16b, - - -, 16n are made to have gradually smaller extensions in the downstream direction of coin flow. As a result, the selecting hole 3a, which is located furthest upstream near the coin turning mechanism 1, is formed to have the smallest width whereas the remaining selecting holes 3b, - - -, 3n are formed to have gradually larger widths in this order. Each adjacent pair of the selecting holes 3a, 3b, - - -, 3n is defined by means of a transfer plate 17. A track bottom plate 18 is provided between the outlet 2 of the turning disc mechanism 1 and the most upstream selecting hole 3a.

The selecting belt mechanism 5 is equipped with a corresponding number of carrying mechanisms 19a, 19b, - - -, 19n+1, on which belts 20a, 20b, - - -, 20n+1 are made to run under tension in a manner to correspond to the track bottom plate 18 and the selecting holes 3a, 3b, - - -, 3n. The belts 20a, 20b, - - -, 20n+1 are arranged at an inclination to the reference rail 15 so that their spacing from the reference rail 15 is gradually less in the downstream direction. The belt carrying mechanism 19a, which is located to have its belt 20a running above the track bottom plate 18, is equipped with pulleys 22a and 23a at opposite ends of its spindle 21a. The pulley 22a is positioned to receive the driving force or rotation of the drive pulley 13, whereas the pulley 23a is positioned to carry the belt 20a together with a driven pulley 24a which is supported on one end of an arm 25a. The other end of this arm 25a is pivotally supported at a pivot 26a. Moreover, the driven pulley 24b of the next downstream belt carrying mechanism 19b is likewise positioned in a manner to coextend above the selecting track bottom plate 18 with the pulley 23a. The belt carrying mechanism 19b has its one pulley 22b made receptive of the rotations of the pulley 22a. The driven pulley 24c of the next downstream belt carrying mechanism 19c is arranged to coextend above the selecting track bottom plate 18 with the other pulley 23b of the upstream belt carrying mechanism 19b. The belt carrying mechanism 19c also has its pulley 22c made receptive of the rotations of the pulley 22b of the upstream belt carrying mechanism 19b. The remaining belt carrying mechanisms 19d, - - -, 19n+1 are constructed and arranged similarly to those described above.

Each of the selecting holes 3a, 3b, - - -, 3n is connected to a coin guide cylinder or chute (not shown) so that the coins $C_1, C_2, - - -, C_n$ may be counted after they pass through the coin guide cylinders.

The operation of the coin selecting apparatus thus constructed will be described in the following. When the mixed coins $C_1, C_2, - - -, C_n$ are poured onto the rotary disc 6 by way of a hopper (not shown), they are fed off along the selecting ring 7 and onto the coin aligning course 8 by the centrifugal force of the rotary disc 6. After alignment into a single file on the coin aligning course 8, they pass to the outlet 2. The mixed coins $C_1, C_2, - - -, C_n$ thus fed to the outlet 2 are unidirectionally conveyed on the track bottom plate 18 of the selecting track 4 by the running belt 20a of the belt carrying mechanism 19a. The mixed coins $C_1, C_2, - - -, C_n$ thus conveyed by the belt 20a are transferred to the belt 20b of the next downstream belt carrying mechanism 19b. During the conveyance by the belt 20b, the coins $C_1$ having the smallest diameter fall down through the selecting hole 3a having the smallest size. More specifically, since the belt 20a is arranged at an inclination with respect to the reference rail 15 so as to approach the rail 15 as the running of the belt 20b proceeds, the mixed coins $C_1, C_2, - - -, C_n$ are conveyed while having their lower sides partially placed on the guide edge 15a of the reference rail 15 and their circumferences are forced into contact with the inner wall of the reference rail 15. The coins $C_1$ of the smallest diameter have their lower side portions, which are located at the opposite positions to those in contact with the inner wall of the reference rail 15, gradually leaving first of all from the selecting edge 16a of the selecting rail 16 until the coins $C_1$ fall into the selecting hole 3a. The remaining coins $C_2, - - -, C_n$ having larger diameters than the coins $C_1$ are conveyed on the guide edge 15a and the selecting edge 16a, while spanning the selecting hole 3a, so that they can pass over the hole 3a until they are transferred to the belt 20c of the next downstream belt carrying mechanism 19c. This transfer is accomplished on the transfer bottom plate 17 so that the troubles, which might otherwise take place during the transfer, can be prevented. During the conveyance by the belt 20c, the coins $C_2$ having the second smallest size fall into the selecting hole 3b. Likewise, the remaining coins $C_3, - - -, C_n$ are made to consecutively fall into the selecting holes 3c, - - -, 3n, respectively. When, on the other hand, the belts 20a, 20b, - - -, 20n+1 fail to accomplish their proper running operations as in the case where there exists deformed or bent coins among the mixed coins $C_1, C_2, - - -, C_n$ being conveyed on the selecting track 4, such deformed coins can be easily taken out or removed simply by raising the corresponding arm or arms 25a, 25b, - - -, 25n+1 about the pivot or pivots 26a, 26b, - - -, 26n+1.

As will be easily understood from the descriptions thus far made, the number of the selecting holes 3a, 3b, - - -, 3n to be formed in the selecting track 4 is made equal to that of the number of kinds of coins to be selected (e.g., six for Japanese coins including the old but still circulating 50 yen coins and that the sizes of the holes 3a, 3b, - - -, 3n are made stepwise wider than the diameters of the respective coins to be selected thereby. On the other hand, the running speeds of the belts 20a, 20b, - - -, 20n+1 of the respective belt carrying mechanisms 19a, 19b, - - -, 19n+1 may be stepwise raised by the use of suitable means, e.g., by stepwisely reducing the diameters of the pulleys 22a, 22b, - - -, 22n+1. If this is done, it is possible, without rail, to prevent the undesirable phenomena of clearances occurring between the coins being conveyed on the selecting track 4 so that a coin of a smaller diameter, e.g., $C_1$, fails to fall into the selecting hole 3a thereby to pass over the hole 3a while being held between coins of a larger diameter, e.g., $C_3$.

As has been explained in detail hereinbefore, according to the present invention, the selecting belt mechanism for unidirectionally conveying the mixed coins on the selecting track is composed of a plurality of the belt carrying mechanisms. As a result, it should be appreciated as an advantage of the present invention that the belts to be carried can be arranged at a larger angle of inclination than the conventional coin selecting apparatus, in which a single belt is arranged to extend over the whole length of the selecting track. This ensures that in the selection of the coins the mixed coins being conveyed never fail to contact with the inner wall of the reference rail, while also ensuring that the portions of the coins opposite to the contacting portions gradually leave the selecting rail and accordingly fall into their corresponding selecting holes. Since, moreover, the running speeds of the belts of the selecting belt mechanism are stepwisely raised in the downstream direction of coin flow, it should be appreciated as another advantage of the present invention that there is no fear of any clearance developing between adjacent coins being conveyed, thus enhancing the selecting efficiency.

On the other hand, even if jam occurs due to the existence of a deformed coin, this coin can be removed with ease because the belt mechanism is divided into a plurality of belt carrying mechanisms.

What is claimed is:

1. A coin selecting apparatus for selecting mixed coins in accordance with the diameters thereof, comprising:

a selecting track having a bottom formed with a plurality of selecting holes which are arranged in a file in the flow direction of the coins and which are sized to have gradually larger widths in the downstream direction of the coin flow; and a selecting belt mechanism for conveying the coins on said selecting track so that the coins fall into the selecting holes in the order of increasing coin diameters, said selecting belt mechanism including a plurality of belt carrying mechanisms arranged on said selecting track for carrying a corresponding number of belts such that the running directions of the belts are inclined at a preset angle with respect to the longitudinal direction of said selecting track, and such that each of the belts partially overlaps the next downstream belt;

said apparatus further comprising a plurality of arms, one for each said belt carrying mechanism, normally arranged to extend substantially over each of the coins of said selecting track, and pivoting means, one for each said arm, for pivoting said each arm away from said coins so as to provide easy access to the coins being conveyed, whereby to permit easy and efficient removal of a deformed coin when a jam occurs on said selecting track due to the existence of said deformed coin.

2. A coin selecting apparatus according to claim 1, wherein said selecting track includes a reference rail which is formed with a guide edge having a preset width, and a selecting rail which is arranged substantially parallel to said reference rail at a preset spacing and which is formed with a plurality of selection edges having widths gradually decreasing in the downstream direction of the coin flow so as to leave said selecting holes, respectively, between said selecting edges and the guide edge of said reference rail.

3. A coin selecting apparatus according to claim 1, further comprising a transfer plate which is arranged at the overlapped portions of each pair of adjacent rails of said belt carrying mechanisms in a manner to define two adjacent selecting holes of said selecting track whereby to eliminate any trouble which might otherwise occur.

4. A coin selecting apparatus according to claim 1, further comprising drive means for driving said belt carrying mechanisms.

5. A coin selecting apparatus according to claim 4, wherein said drive means includes a pulley train for stepwisely raising the running speeds of belts of said belt carrying mechanisms, thereby generating the clearances which might otherwise occur between the coins being conveyed on said selecting track.

* * * * *